United States Patent [19]

Brown

[11] Patent Number: 4,537,345

[45] Date of Patent: Aug. 27, 1985

[54] FLAME CONTROL SYSTEM FOR HEAT EXCHANGER

[75] Inventor: Claude D. Brown, Arvada, Colo.

[73] Assignee: BBC Industries Inc., Grass Valley, Calif.

[21] Appl. No.: 463,328

[22] Filed: Feb. 2, 1983

Related U.S. Application Data

[63] Continuation-in-part of Ser. No. 432,074, Sep. 30, 1982, Pat. No. 4,487,361, which is a continuation-in-part of Ser. No. 237,822, Feb. 25, 1981, abandoned.

[51] Int. Cl.[3] ..... F24D 5/00

[52] U.S. Cl. ..... 236/11; 237/53

[58] Field of Search ..... 237/55, 50, 19; 236/10, 236/9 A, 9 R; 126/110 R; 165/DIG. 2

[56] References Cited

U.S. PATENT DOCUMENTS

| | | | |
|---|---|---|---|
| 2,163,910 | 7/1939 | Lattner | 237/19 X |
| 2,266,563 | 12/1941 | McCorkle | 236/11 |
| 3,831,663 | 4/1973 | Pithie | 165/26 |
| 3,838,811 | 4/1973 | McMann | 236/10 |
| 4,019,569 | 9/1974 | McMann | 165/26 |
| 4,136,730 | 7/1977 | Kinsey | 165/12 |
| 4,140,274 | 2/1979 | Nabinger | 236/11 |
| 4,156,502 | 11/1977 | Day | 236/46 |
| 4,175,699 | 11/1979 | Engeling et al. | 237/55 |
| 4,199,023 | 11/1977 | Philips | 165/12 |

OTHER PUBLICATIONS

Service Manual for Continuous Air Circulation Technicians, First Edition, Dec. 1947, Copyright 1947 by National Warm Air Heating & Air Conditioning Association, 145 Public Square, Cleveland 14, Ohio, Manual 6 of Practical Warm Air Heating.

*Primary Examiner*—Henry Bennett

*Attorney, Agent, or Firm*—Townsend & Townsend

[57] ABSTRACT

Control circuits are provided for a heat exchange unit including environment responsive means placed in the general area of the heat exchange unit's heat exchanger or of the associated heat distribution network or return system. The environment responsive means is connected in series between the heat exchange unit's main control switch, such as a thermostat, and the fuel valve which controls the flow of fuel to the unit's burner. The environment responsive means may be either independent of, or connected in parallel with a heat circulator if any, associated with the unit's heat exchanger. The control circuits of the present invention control the action of the heat exchange units fuel valve to create an intermittent heating flame in response to environmental changes at the heat exchanger, heat distribution network or return system during each heat demand cycle. This conserves fuel and energy by intermittently terminating the flow of fuel, and thus the burning of fuel, during each heat demand cycle while continuing to utilize and distribute heat stored in the heat exchanger during non-fuel burning periods of each heat demand cycle.

12 Claims, 6 Drawing Figures

FLAME CONTROL SYSTEM FOR HEAT EXCHANGER

CROSS-REFERENCE TO RELATED APPLICATIONS

This is a continuation-in-part of application Ser. No. 432,074 filed Sept. 30, 1982, now U.S. Pat. No. 4,487,361 which is in turn a continuation-in-part of Ser. No. 237,822 filed Feb. 25, 1981 now abandon. Also the invention has been disclosed to the United States Patent and Trademark Office as Disclosure Document No. 090493, received May 5, 1980.

BACKGROUND OF THE INVENTION

The present invention relates to means for automatically controlling the heat cycle in a heat exchange unit such as a furnace. More specifically it relates to means for controlling the ON-flame or burn cycle in such a furnace in response to environment responsive means associated with the heat exchanger or the heat distribution system associated with the furnace.

DESCRIPTION OF THE PRIOR ART

Prior art references known to applicant are set forth in accompanying Form 1244.

Most furnaces, and especially gas and oil fueled furnaces and similar heating units, generate heat by flowing fuel to a burner in or adjacent to a heat exchanger. The heat exchanger and its associated heat distribution system, if any, distributes or otherwise places the heat energy into beneficial use. However, in most such units the fuel is burned continuously during each heat demand cycle with the result that heat is generated more rapidly than it can be used, or absorbed and circulated for beneficial use. Analysis and research indicates that in most such prior art heating systems at least 30%, and often as much as 50% or more of the heat energy generated by the heating system is not put to a beneficial use, and is thus wasted and lost, for example through the chimney flue and the like. This is apparently due to the fact that state-of-the-art heat exchangers and their related distribution systems cannot conduct or circulate the heat for beneficial use as fast as the heat is generated by the fuel which is continuously being burned.

Most such prior art heating systems, and especially home heating systems, are activated "ON" and "OFF" during what is known as a "heat demand cycle", controlled by one or more temperature responsive thermostat switches, or other ON-OFF control switches located, for example, in the space to which the heat is to be conducted, such as the rooms of a home. Normally, once a heat demand cycle is initiated fuel is fed to one or more burners, where the fuel is fired to an ON-flame status to heat any adjacent heat exchanger. Once initiated, the flow of fuel to the burner and the ON-flame cycle continue until the heat demand cycle is terminated by the control switch. The heat demand cycle is terminated, for example, in response to a thermostat, in response to a time cycle, in response to a manually controlled switch or in response to a combination of such controls. No prior art system is known which intermittently stops and starts the flow of fuel, and therefore burning, during a single heat demand cycle.

It is now postulated that by providing intermittent "ON-flame", and "OFF-flame" periods during a single heat demand cycle. Such ON-flame, OFF-flame cycles would be in response, for example, to the temperature at the heat exchanger or in the heat distribution system, or in response to other environmental changes caused by the heat exchanger or distribution system during a heat demand cycle. Such ON-flame, OFF-flame cycles allow the total amount of heat generated during a heat demand cycle to be reduced, the amount of heat energy beneficially utilized to be maximized, and the amount of fuel burned to be reduced, with a concommitant reduction in cost of operation.

SUMMARY OF THE INVENTION

The present invention overcomes the short comings of the prior art devices through the provision of novel control circuits which include environment responsive means. Such environment responsive means may be placed in various locations, including the general area of the heat exchange unit's heat exchanger or in the associated heat distribution network or return system. The environment responsive means is connected in series between the heating system's main control switch, such as a thermostat located in the to-be-heated area, and the fuel valve which controls the flow, of fuel to the unit's burner. The environment responsive means may be either independent of, or connected in parallel with, the unit's heat circulator, if any, which heat circulator is associated with the heat exchanger. Such a heat circulator may be, for example, a fan or a fluid pump. Gravity heat distribution systems may not require a circulator device. As set forth in more detail below, the control circuits of the present invention control the action of the heating unit fuel valve to create an intermittent heating flame, or ON-flame and OFF-flame cycles, in response to environmental changes at the heat exchanger, heat distribution network, or return system during each heat demand cycle.

It is therefore an object, feature and advantage of the present invention to provide a new and improved heat exchange control circuit which conserves fuel by intermittently terminating the flow of fuel during each heat demand cycle in response to a change in the environment of the heat exchanger or heat distribution or return system, and which continues to utilize and distribute the heat stored in the elements of the heat exchanger during one or more OFF-flame periods of each heat demand cycle.

Another and further object of the present invention is to provide a novel heat exchanger flame control circuit arrangement and method for conserving energy by reducing wasted heat in a heating furnace system or other such heating system.

Another and additional object of the invention is to provide a very simple, yet significantly effective improvement over any similar devices and systems of the prior art.

These and other objects of the present invention will become apparent to those skilled in the art from the following detailed description, showing the novel construction, combination and arrangement of parts as herein described, and more particularly defined by the appended claims, it being understood that such changes in the precise embodiments of the herein disclosed invention are meant to be included as come within the scope of the claims except insofar as precluded by the prior art.

BRIEF DESCRIPTIONS OF THE DRAWINGS

The accompanying drawings illustrate complete preferred embodiments of the present invention according to the best mode presently devised for the practical application of the principles thereof, and in which.

DESCRIPTION OF THE PREFERRED EMBODIMENTS

Figure 1:
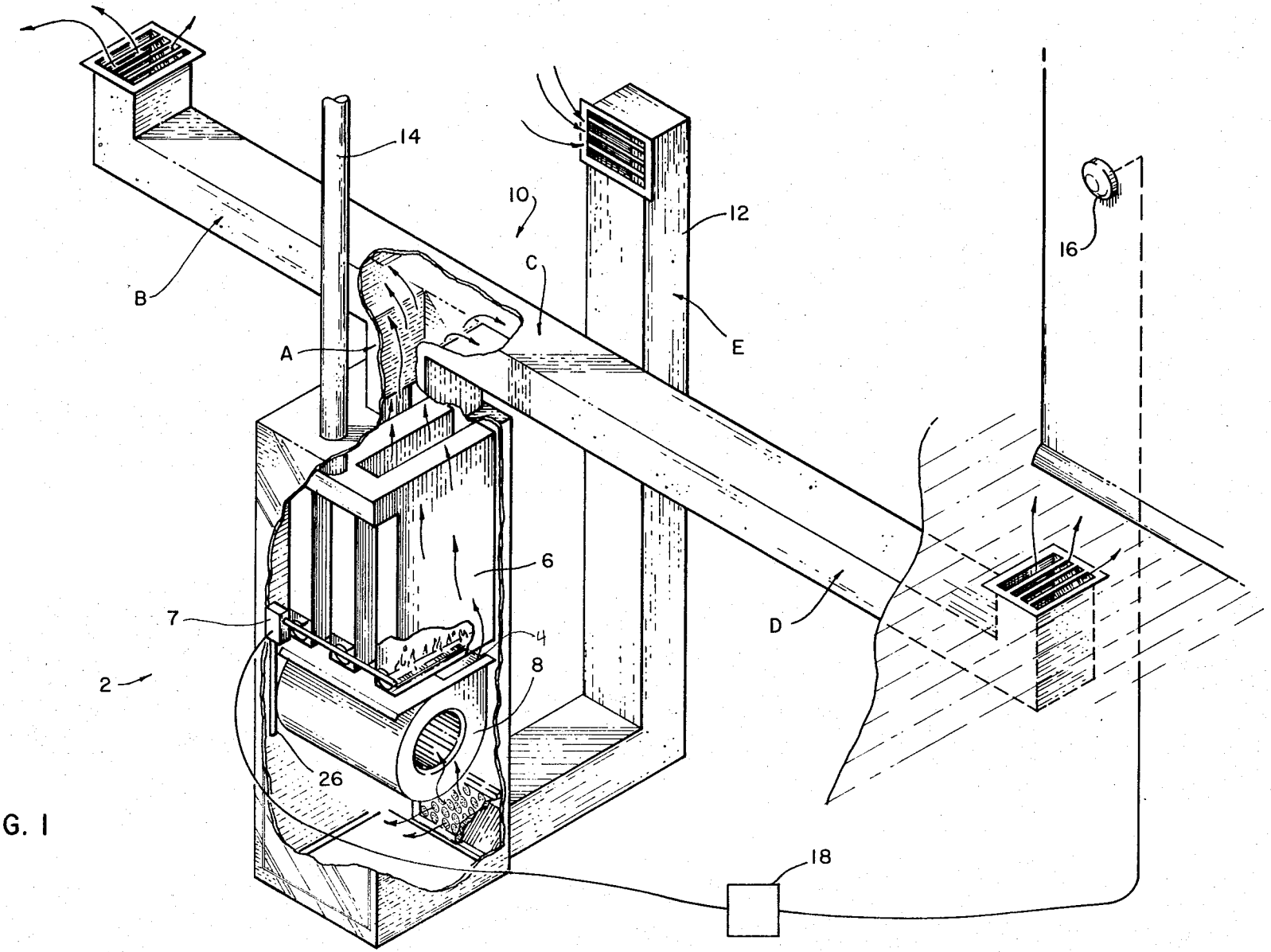
FIG. 1 is a diagramatic representation of a typical furnace and heat distribution system of the type with which the present invention may be utilized.

Referring now to the drawings, there is shown in FIG. 1 a typical furnace heat exchange unit and heat distribution system of the kind with which the present invention may be utilized. Typically such a furnace system 2, outlined in phantom, includes one or more burners 4 juxtaposed to a heat exchange unit 6. The flow of fuel to burner 4 is controlled by fuel valve switch and circuit 7. Heat circulator 8 causes heat from heat exchanger 6 to be distributed through bonnet 9 to to-be-heated areas by heat distribution network 10. To be heated fluids enter or return to the vicinity of heat exchanger 6 by means of fluid return system 12. Combustion products and undistributed heat exit the system through flue 14. The heat demand cycle of such a system is normally controlled by a single control switch 16, such as a thermostat. As described in greater detail below, environment responsive circuit 18 is provided by the present invention intermediate switch 16 and burner 4.

The system, as shown schematically, is a gas burning hot air circulating system including a blower fan. However, for the purposes of the present invention the system may burn any fluid fuel which can be controlled by a valve, such as oil or gas, and the heat distribution network and return may circulate air, steam, hot water, or any other heat exchange fluid with state-of-the-art modifications. Heat exchanger 6 may be a baffled box, a hot water tank a boiler, or the like. Heat circulator 8 may be a blower or a pump. Heat distribution network 10 and return 12 may be ducts, or, with interconnection, pipes. Control switch 16 may be a thermostat, a timer, a manually or mechanically operated switch, but is external to and not normally juxtaposed to furnace 2, heat exchanger 6 or heat distribution and return system 10 and 12.

Figure 2:
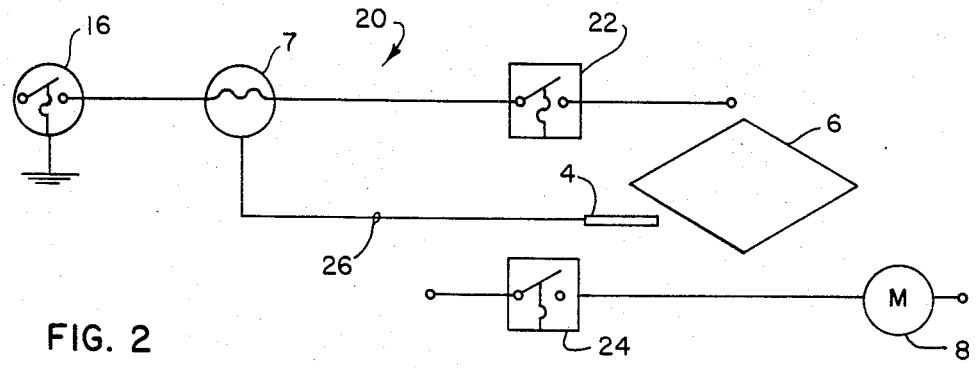
FIG. 2 is an exemplary schematic and block diagram characterization of the known related prior art.

Referring now to FIG. 2 there is shown a prior art heating system control circuit 20, having a thermostat or other control switch 16, normally closed (operative) fuel valve circuit 7 controlling the flow of fuel to burner 4, normally closed high heat responsive limit control means 22 and normally open low heat responsive circulator control means 24, the latter two elements being closely located to diagramatically represented heat exchanger 6. All of these elements are connected to and powered by one or more conventional, power source (not shown). Normally closed high heat responsive means 22 will open to shut off fuel valve 7 in response to a predetermined too high temperature at heat exchanger 6, while normally open low heat responsive means 24 closes to turn on circulator 8 once a predetermined minimum heat has been achieved at heat exchanger 6.

In operation, a signal from control switch 16 closes, and thus causes fuel to be passed by or through fuel valve circuit 7, through fuel line 26, to burner 4, adjacent heat exchanger 6. The fuel is ignited to an ONburn cycle at burner 4, for example by a pilot light, not shown, and is burned to raise the temperature of heat exchanger 6. Diagramatically represented heat exchanger element 6, exemplary of the type used in state-of-the-art heating systems, is associated with heat distribution network 10 (not shown in FIG. 2, but see FIG. 1) for distributing heat throughout the area served by the heating system. This is accomplished by circulating means 8 which moves fluids (air, water, etc.) by or through exchanger 6, where the fluids are heated and thence conveyed by network 10 throughout the area served by the heating system. However, in the operation of such prior art systems, once an ON-burn sequence is initiated by the closing control switch 16, then fuel continues to flow through valve 7 to burner 4, and fuel is burned continuously throughout the heat demand cycle.

Figure 3:
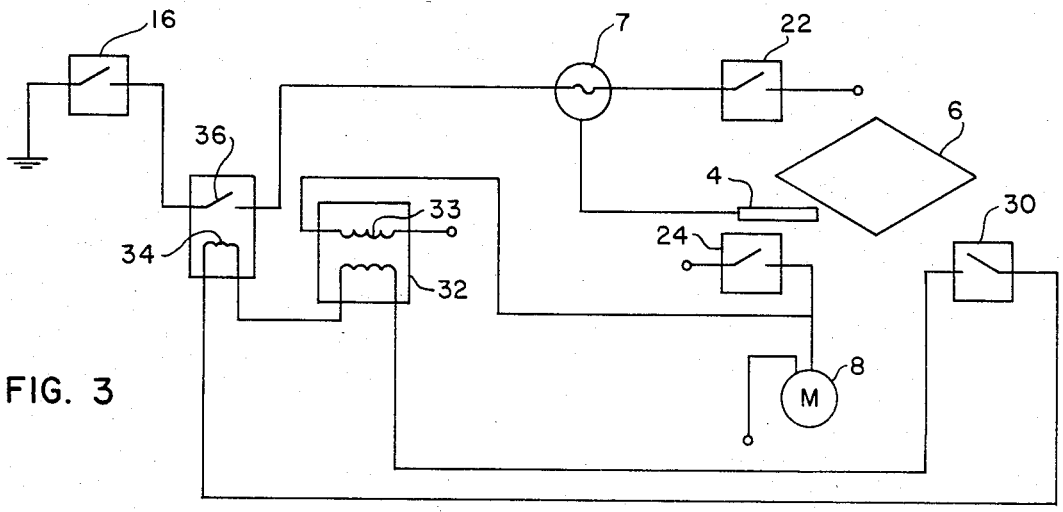
FIGS. 3 and 4 are composite schematic and circuit diagrams of heating systems incorporating preferred embodiments of circuits of the present invention in which the enviroment sensing means are associated with the heat exchanger.

The present invention differs from the prior art. In one simplified embodiment of the present invention, shown and illustrated diagramatically and schematically by FIG. 3, the normally open main thermostat or control switch 16, normally open fuel valve circuit 7, heat exchanger 6, normally closed high heat responsive limit control means 22, and normally open low heat responsive-circulator control means 24, are connected to provide a conventional control circuit in any well-known manner, for example similar to that of the prior art, illustrated by FIG. 2. Main control 16, fuel valve circuit 7 and high heat switch 22 operate in series on a conventional, usually low voltage source (not shown), as is well known in the art. Circulating means 8 is usually connected to a high voltage (house voltage) energy source (not shown), and is activated in response to the closing of normally open low heat responsive control switch 24. However, as an improvement of the present invention, in this embodiment a normally open environmental responsive switch, in this case temperature responsive control 30 is provided. Temperature responsive switch 30 is energized by, for example, transformer 32 in which the primary coil 33 is in parallel with low limit switch 24. Temperature responsive switch 30 is also operatively connected to relay coil 34 which controls normally closed relay switch 36, as shown in FIG. 3. While not immediately apparent from FIG. 3, temperatures responsive means 30 is preferably physically located adjacent to or inserted into heat exchanger 6 so that it may detect the temperature variations of or at heat exchanger 6.

In operation, as with the prior art, when main switch or thermostat 16 is turned on (closed), it completes a circuit through normally closed relay 36 to close (operate) fuel valve circuit 7. This causes fuel to pass to and be ignited by burners 4, associated with heat exchanger 6. When a predetermined temperature is reached in the vicinity of heat exchanger 6, normally open low heat responsive switch 24 closes, causing circulator 8 to operate and move to-be-heated fluids by or through heat exchanger 6. With the closing of switch 24, transformer 32 is energized through primary coil 33.

However, in the operation of the present invention, when normally open temperature responsive switch 30 detects a predetermined temperature, the contact of switch 30 closes, thereby completing the transformer 32 energized circuit through relay coil 34. Then, in response to current flowing through relay coil 34, normally closed relay switch 36 is caused to open, thus disrupting the circuit to fuel valve 7. When fuel valve circuit 7 becomes inoperative (is opened) it disrupts the flow of fuel to, and thus the ON-flame status of burners 4, even though switch 16 may still be closed so that the heat demand cycle still calls for heat. During this disruption of valve circuit 7, the temperature of heat exchanger 6 is initially high, and heat from heat exchanger 6 is put to beneficial use by circulator 8. Thus the high retained heat of heat exchanger 6 is not wasted.

As heat exchanger 6 cools, for example, as a result of heat circulating device 8 removing heat for beneficial use, heat responsive element 30 senses the drop in temperature, and at a predetermined reduced temperature resumes its normally open status. The opening of switch 30 then opens or disrupts the circuit to relay coil 34 of control switoh 36, thus in turn allowing switch 36 to resume its normally closed position. Then, with the closing of switch element 36 the circuit to fuel control valve 7 is once again completed allowing the operation (closing) of fuel valve circuit 7, the transmission to and firing of fuel at burner 4, and additional heating of heat exchanger 6.

Thus, in the practice of the present invention, such ON-flame, OFF-flame cycles will continue intermittently, in response to the heating (closing) and cooling (opening) of heat responsive switch 30, throughout each heat demand cycle. When the temperature of the room or space being heated is sufficiently high, or when thermostat or switch 16 is otherwise caused to open, the circuit to the fuel valve 7 will be opened to end the heat demand cycle. If normally open low temperature responsive switch 24 is closed, fluid circulator 8 will continue to operate until switch 24 opens.

In the embodiment shown in FIG. 3, temperature responsive switch 30 is energized through transformer 32, and thus is only operative when normally open low temperature responsive switch 24 is closed. Therefore, in the perferred embodiment, of FIG. 3, heat responsive means 30 is normally set to reclose at a temperature higher than low heat responsive switch 24. A simple modification (not shown) of the circuit of FIG.3, would provide energization to temperature responsive switch 30 and relay coil 34 independently of low temperature switch 24. In such a configuration switch 30 would be capable of operating regardless of the status of switch 24. This latter arrangement would also allow temperature responsive switch 30 to be set at a predetermined temperature lower than the temperature of switch 24.

Figure 4:
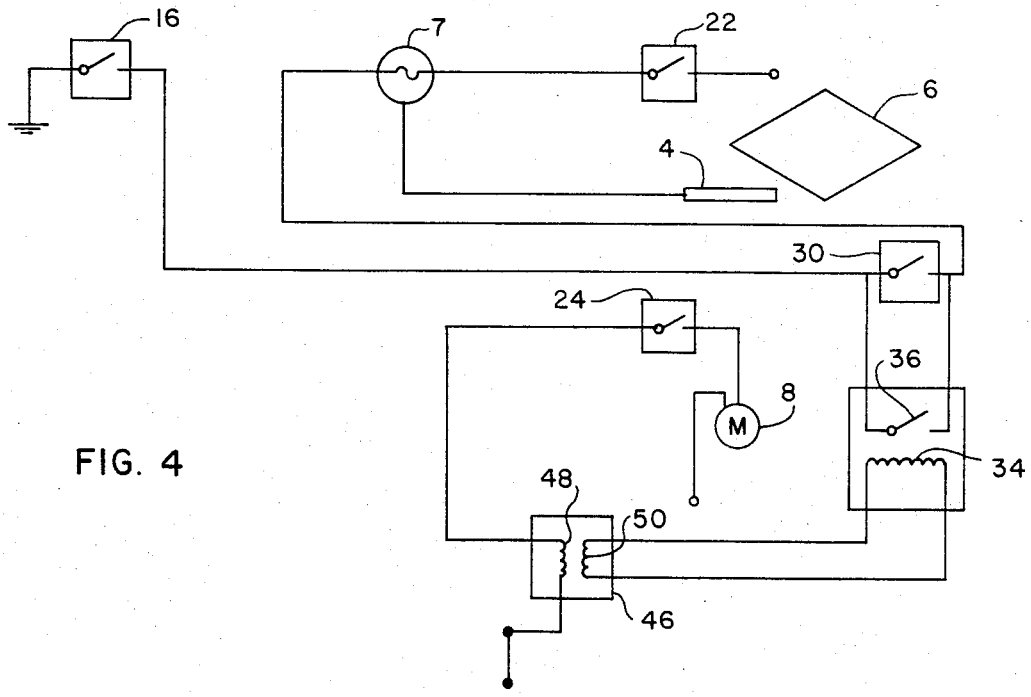

Another embodiment of the present invention is illustrated in FIG. 4. In this system control switch or thermostat 16, fuel valve circuit 7, high heat responsive limit control means 22, low temperature responsive circulator control means 24, heat exchanger 6, and circulator pump or fan means 8 all operate, substantially as their counterparts described in FIGS. 2 and 3.

The preferred embodiment of FIG. 4 is representative of the type of system which is used with a standard home or other type of heating furnace 2 when the temperature of heat exchanger 6 is sensed to control fuel valve circuit 7. Various heat sensing and timing devices are normally associated with such a furnace, and these devices might be set in such a manner that the heat limiting circuit of the present invention may become activated to cause an OFF-burn condition before normally open low temperature responsive sensor 24 is heated to a temperature which causes it to close and activate heat circulator 8. However, the substantially continuous activity of heat circulator 8 during each heat demand cycle is desired in order to increase the efficiency of the present system. The embodiment set forth in FIG. 4 assures the ability of heat circulator 8 to become activated, regardless of when the heat limiting environment sensing circuit of the present invention is activated. It also allows the heat limiting circuit of the present invention to operate intermittently during each heat demand cycle.

In the embodiment FIG. 4, a normally closed heat responsive switch 30, which is actually juxtaposed or inserted by means of a probe into the area of heat exchanger 6, is in series relation between control switch or thermostat 16 and fuel valve 7. In the same circuit, in parallel relationship to temperature responsive switch 30, is normally closed relay switch 36. When closed, relay switch 36 serves as a shunt to bypass or override temperature responsive switch 30. Relay 36 is associated with activating coil 34 which is energized to open normally closed relay switch 36 when normally open low temperature responsive switch 24 is closed to activate circulator 8. In the embodiment shown in FIG. 4, this energization of coil 34 is accomplished by means of transformer 46 which is in parallel to circulator 8; with this portion of the system being seperately energized by a high voltage source, such as 110 volte A.C. house current. Transformer 46 includes high power source primary winding 48 and secondary winding 50. Winding 50 is continuously coupled in series to activating coil 34. By this arrangement, the closing of normally open low temperature responsive switch 24 energizes primary winding 48 of transformer 46, which in turn energizes secondary winding 50 and associated activating coil 34. When coil 34 is activated, normally closed relay 36 is opened so that relay 36 can no longer serve as a bypass of temperature responsive switch 30.

In the operation of the embodiment of FIG. 4, a heat demand cycle is initiated by activating switch or thermostat 16. This completes a circuit through both normally closed temperature responsive switch 30 and parallel normally closed relay 36 to fuel valve 7. The activation of fuel valve 7 causes the flow of fuel to burner 4 which initiates an ON-burn cycle to raise the temperature of heat exchanger 6. Then, if normally open low temperature responsive switch 24 is heated to a predetermined temperature which causes switch 24 to close before normally closed temperature responsive switch 30 is caused to open, then activating coil 34 is activated in response to the energization of primary winding 48 of transformer 46, thus activating secondary winding 50. This in turn causes normally closed switch 36 to open. Thereafter, switch 24 will normally remain closed during the balance of the heat demand cycle (and usually beyond) so that temperature responsive switch 30 thereafter becomes the sole controlling element in the continued or intermittent operation of fuel valve circuit 7.

Similarly, in the initial operation of the embodiment of FIG. 4, if after the ON-flame cycle is initiated, normally closed temperature responsive switch 30 is activated open before normally open low limit switch 24 is closed, then, rather than disrupting fuel valve circuit 7 to cause an OFF-flame cycle, the circuit to fuel valve circuit 7 remains complete through the by-pass provided by normally closed relay 36. Thus heating of heat exchanger 6 continues at least until normally open low temperature responsive switch 24 is caused to close, with the concommittant activation of circulator 8. As previously described, after switch 24 is closed then activating coil 34 is energized, causing relay 36 to be opened and remain open, with the result that during the balance of the heat demand cycle temperature responsive switch 30 becomes the sole controlling element in the continuous or intermittent operation of fuel valve circuit 7.

In the system of FIG. 4, after operation of a heat demand cycle is complete and switch 24 reopens, then activating coil 34 is no longer energized through transformer 46 and relay switch 36 returns to its normally closed position so that it is ready for the next heat demand cycle.

Figure 5:
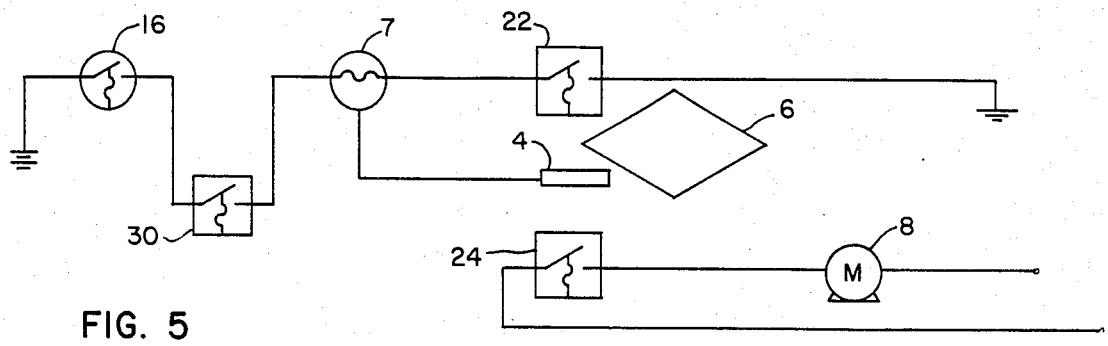
FIG. 5 and 6 are composite schematic and circuit diagrams of heating systems incorporating another preferred embodiment of circuits and systems of the present invention in which an enviroment sensing means is located in or adjacent to the heat distribution system.

The embodiment of FIG. 5 is representative of the preferred type of system which is used with a standard home or other type of heating furnace 2 when the environment of the system remote from heat exchanger 6 is sensed to control fuel valve circuit 7.

In the embodiment of FIG. 5, a normally closed environment responsive switch 30', which is remote from heat exchanger 6, is in series relation between control switch or thermostat 16 and fuel valve 7.

In the operation of the embodiment of FIG. 5, a heat demand cycle is initiated by activating switch or thermostat 16. This completes a circuit through closed environment responsive switch 30' and to fuel valve 7. The activation of fuel valve 7 causes a flow of fuel to burner 4 which initiates an ON-burn cycle to raise the temperature of heat exchanger 6. Then, when normally open low temperature responsive switch 24 is heated to a predetermined temperature, switch 24 closes and activates seperately energized circulator 8, thus causing heated fluid to flow through heat distribution network 10 and to return through system 12. The flow of heated fluid through network 10 and the return through system 12 results in an increase or decrease in pressure in various parts of network 10 and system 12, and an increase in temperature in network 10. Environment responsive switch 30' may be activated from its normally closed to an open position mechanically, for example, by fluid flow or pressure change, or by temperature increase above a predetermined temperature. Thereafter, during the balance of the heat demand cycle, environment responsive switch 30' becomes the sole controlling element in the continued or intermittent operation of fuel valve circuit 7.

Now considering FIG. 5 in additional detail, environment responsive switch 30' may be a normally closed switch, similar to that described in the embodiment of FIG. 4. However, as taught with regard to the embodiment of FIG. 5, switch 30' is located remote from, rather than adjacent to, heat exchanger 6. For example, in this embodiment switch 30' may be located in bonnet 9, for example at location A, in heat distribution network 10, for example at locations B, C or D; or in return system 12, for example at location E. When switch 30 is of a heat responsive nature it will function in accordance with the teaching of the present invention at locations such as A, B, C or D, either internally of, or adjacent to bonnet 9 or distribution network 10. When switch 30' is of the type which is mechanically activated, for example by fluid flow, it will function in accordance with the teaching of the present invention at locations A, B, C, D or E within distribution and return system 10 and 12. When switch 30' is of the type which is activated by a change in pressure induced by the activation of circulator 8, it will similarly function in accordance with the teaching of the present invention at locations A, B, C, D or E within the distribution and return system 10 and 12.

It is noted that unlike the embodiment of FIG. 4, in which environment sensing switch 30 is only temperature sensing and adjacent heat exchanger 6, the embodiment of FIG. 5 requires no parallel or shunt path, such as switch 30 of FIG. 4 in order to assure continued flow of fuel to burner 4 until low temperature switch 24 is heated to a temperature at which it closes to activate circulator 8. This is due to the fact that the various environmental changes of heat, fluid flow, pressure change, or the like do not come into play in distribution network 10 or return system 12 until after circulator 8 is activated to cause, for example, an increase in temperature, a fluid flow or a change in pressure at, for example locations A, B, C, D or E. Then, when normally closed switch 30' is temperature sensing, and located, for example at locations A, B, C or D it will remain closed until circulator 8 is activated to move heated fluid through bonnet 9 and network 10. Thereafter, when switch 30 senses a preselected temperature it opens, thus causing the circuit to fluid valve 7 to be disrupted and the flow of gas to burner 4 to be terminated. The closing temperature of switch 30' to restart fuel flow to burner 4 is selected to be a temperature greater than the opening temperature of switch 24 so that circulator 8 remains operative throughout the entire heat demand cycle and the circulation of heated fluids by circulator 8 continues throughout the heat demand cycle. After the heat demand cycle is completed the fluid in bonnet 9 and circulation network 10 cool to a temperature at which switch 30' closes and is capable of completing the circuit between switch 16 and valve 7 in a subsequent heat demand cycle. When switch 30' is pressure or flow sensitive, a timing or other delay system would normally be associated with switch 30' in order to allow a period of flow before switch 30' opens to disrupt the circuit to valve 7 at the start of each heat demand cycle.

Figure 6:
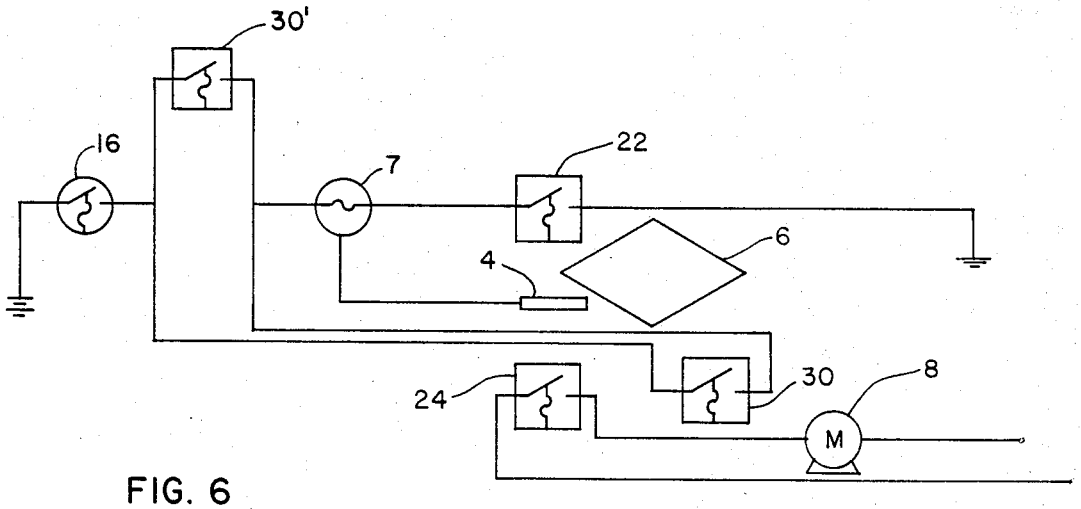

Referring now to FIG. 6, yet another embodiment of the present invention is disclosed which is capable of causing intermittent disruption of burner flame 4 during a single heat demand cycle. The embodiment of FIG. 6 utilizes two environment responsive switches electrically in parallel to one another but both in series between main switch 16 and fuel valve 7. One normally closed environment responsive switch 30 is located adjacent heat exchanger 6, and a second normally closed environment responsive switch 30' is located remote from heat exchanger 6, for example at locations A, B, C, D or E of distribution network 10 or return system 12.

In the operation of the embodiment of FIG. 6, a heat demand cycle is activated by switch or thermostat 16, which when closed completes a circuit through both normally closed environment responsive switches 30 and 30' to fuel valve 7. The activation of fuel valve 7 causes fuel to flow to burner 4, the initation of an ON-burn cycle, an increase in temperature at heat exchanger 6, and the eventual closure of low temperature responsive switch 24 to cause the activation of circulator 8. In this embodiment remote environment sensing switch 30' will remain closed and assure the operation of fuel valve 7 and the flow of fuel to burner 4 until low temperature switch 24 is closed to activate circulator 8 and cause a change in the environment of switch 30'. By selecting a low temperature at which switch 30' opens, or by utilizing a form of switch 30' which is flow or pressure activated, once circulator 8 is activated environment responsive switch 30' will remain open, thus leaving environment responsive switch 30 in complete control of the circuit to valve 7 for the balance of the heat demand cycle. Where environment responsive switch 30 is temperature sensitive, the embodiment of FIG. 6 assures the fuel will flow to burner 4 through switch 30' at least until the temperature of heat exchanger 6 is warm enough to close low temperature switch 24 and activated circulator 8. After the heat demand cycle is completed the conditions at both heat exchanger 6 and in distribution network 10 and/or return system 12 will be such that both environment responsive switches 30 and 30' will once again close to complete the parallel circuits between switch 16 and valve 7 at the start of the next heat demand cycle.

In a modification of the embodiment of FIG. 6, by selecting a normally closed switch 30', which is not environment responsive, is mechanically linked to normally open low temperature responsive switch 24, so that the closing of switch 24 will cause the opening of switch 30'. As with the other uses of the embodiment of FIG. 6 this will assure continued operation of valve 7 through switch 30' at least until switch 24 is closed and circulator 8 activated. Thereafter, environment responsive switch 30 associated with heat exchanger 6 will control the flow of fuel to burner 4 for the balance of the heat demand cycle. On cooling, at the end of the heat demand cycle, the opening of switch 24 would cause switch 30' to close so that the circuit between switch 16 and valve 7 is complete and ready to function at the start of the next heat demand cycle.

Temperature responsive switch 22 has been referred to as a safety shut-off device. By this it is meant that such a switch is heat responsive and is activated at a predetermined high temperature to open (disrupt) the operation of fuel valve circuit 7 should the temperature of the heat exchanger become too high. Temperature responsive switch 24 has been referred to as a low temperature responsive control switch. By this it is meant that normally open switch 24 closes at a preselected temperature which is normally lower than the temperature at which switch 22 opens. Switch 24 permits a warm up period for heat exchanger 6 after the flame comes on at burner 4. If switch 24 was normally closed, or if it closed before the warm-up of heat exchanger 6 then cold fluid would be moved by heat circulating system 8.

The control circuit of the present invention, in general, can be utilized with a furnace having no circulator pump, for example with a gravity hot air or water system, and therefore without a low temperature responsive switch. As the high temperature responsive switch is only a safety mechanism, its presence, while desirable, is not required. As used herein a "fuel valve" or "fuel valve circuit" 7 is any device which controls the flow of the fuel to the burner of the heating system.

In preferred embodiments of the present invention temperature responsive switch 30 is pre-set to be activated (to close in FIG. 3 and to open in FIGS. 4, 5 and 6) at temperatures approximately 10° F. (6° C.) above the activation (closing) temperature of their respective system related low temperature responsive switch 24. In a similar manner temperature responsive switch 30 is set to be deactivated (to open in FIG. 3 and to close in FIG. 4) at temperatures approximately 5°-10° F. (3°-6° C.) below the deactivation (opening) temperatures of related low temperature switches 24. When set in this manner, circulator 8 is capable of and should operate continuously during, and after, each heat demand cycle.

As used herein, the term "heat exchange unit" is intended to include an entire heating system, such as a furnace. However, the term "heat exchanger" designates the portion of the heat exchange unit which is heated by a fueled burner.

While the various circuits shown in the several embodiments may not be operatively complete in an electrical sense, the terminals of each circuit are to be connected to low or high power sources, as indicated in this specification, to be completed in a manner which is well known in the current state-of-the-art.

Additional embodiments of the present invention will be apparent to those skilled in the art. It is therefore intended that the scope of the invention be limited only by the appended claims and the prior art and not by the preferred embodiments described herein. Accordingly, reference should be made to the following claims in determining the full scope of the present invention.

What is claimed is:

1. A heat exchange system comprising:

a thermostat controller for initiating and terminating a heat demand cycle;

a burner directly fluidly coupled to a fuel valve, said fuel valve being operable in the open position to provide a constant fuel supply to said burner and being operable in the closed position to prevent any fuel supply to said burner, said fuel valve being responsive to a heat demand signal from said controller;

a heat exchanger proximate the burner;

a heat duct distribution network arranged and adapted to direct heated fluid from said heat exchanger to a region to be heated; and a temperature responsive switch electrically connected in series with said controller and said fuel valve, said switch arranged and adapted to sense the temperature at a chosen position in said heat duct distribution network remote from said heat exchanger to prevent the application of said heat demand signal to close said fuel valve when the temperature at said chosen position rises above a first temperature, and to permit the reapplication of said heat demand signal to open said fuel valve when the temperature at said chosen position drops below a second temperature.

2. The heat exchange system of claim 1 further comprising:

a fluid circulator; and a normally open fluid circulator switch, responsive to the temperature of said heat exchanger and operably coupled to said fluid circulator, adapted to close and activate said circulator when the temperature of said heat exchanger rises above a certain temperature.

3. The heat exchange system of claim 2 further comprising a high temperature safety switch arranged and adapted to close said fuel valve to halt the delivery of fuel to said burner when the temperature at said heat exchanger is above a chosen temperature.

4. A control system for use with heat exchange systems of the type including a thermostat controller for initiating and terminating a heat demand cycle, a burner directly coupled to a fuel valve, said fuel valve and controller being operably connected along a control line, said fuel valve being operable in the open position to provide a constant fuel supply to said burner and being operable in the closed position to prevent any fuel supply to said burner, said fuel valve being responsive to a heat demand signal transmitted from said controller to said fuel valve along said control line, a heat exchanger proximate said burner, a heat duct distribution network arranged and adapted to direct heated fluid from said heat exchanger to a region to be heated, the control system comprising a temperature responsive switch electrically connected along said control line in series with the controller and fuel valve, said switch arranged and adapted to sense the temperature at a chosen position in said heat duct distribution network remote from said heat exchanger to prevent the application of said heat demand signal to close said said fuel valve when the temperature at said chosen position rises above a first temperature, and to permit the reapplication of said heat demand signal to open said fuel valve when the temperature at the chosen position drops below a second temperature.

5. The control system of claim 4 further comprising:

a fluid circulator adapted to force a fluid past said heat exchanger; and a normally open fluid circulator switch, responsive to the temperature at said heat exchanger and operably coupled to said fluid circulator, adapted to close and activate the circulator when the temperature of said heat exchanger rises above a certain temperature.

6. A method for controlling the operation of a heating system comprising the following steps:

initiating and terminating a heat demand signal according to the temperature within a region to be heated;

directing the heat demand signal to a fuel valve;

actuating said fuel valve upon receipt of said heat demand signal from a thermostatic controller;

providing a burner with fuel directly from the actuated fuel valve;

burning the provided fuel at said burner:

heating a heat exchanger, located proximate said burner, with the burning fuel;

circulating a heating fluid past said heat exchanger thereby removing heat from said heat exchanger;

directing said heating fluid from said heat exchanger, through a heat duct distribution network and to the region to be heated;

monitoring the temperature of said heating fluid in said heat duct distribution network at a position remote from said heat exchanger;

interrupting said heat demand signal to close said fuel valve when the temperature at said position remote rises above a first temperature: and permitting said heat demand signal to be reapplied to open said fuel valve when the temperature at said remote position drops below a second temperature.

7. The method of claim 6 wherein the circulating step includes the steps of:

blowing air past said heat exchanger with a blower;

sensing the temperature at said heat exchanger; and actuating said blower when the temperature at said heat exchanger rises above a certain temperature.

8. A flame control system for use with heat exchange systems of the type including a controller for initiating and terminating a heat demand cycle, a burner directly coupled to a fuel valve, said fuel valve being operable in the open position to provide a constant fuel supply to said burner and being operable in the closed position to prevent any fuel supply to said burner, said fuel valve being responsive to a heat demand signal from said controller, a heat exchanger proximate said burner, a fluid circulator arranged and adapted to remove heat from said heat exchanger, and a normally open fluid circulator switch, responsive to the temperature of the heat exchanger and operably coupled to said fluid circulator, adapted to close and activate said circulator when the temperature of said heat exchanger rises above a certain temperature, the control system comprising:

a normally closed relay switch mounted in series with said controller and operably coupled to a relay coil, said relay coil and relay switch arranged and adapted so energization of said relay coil causes said relay switch to open;

means, operably coupled to the fluid circulator switch, for energizing the relay coil when said fluid circulator is energized; and a temperature responsive switch means, adapted to sense said heat exchanger temperature, for permitting the energizing of the relay coil when the temperature of said heat exchanger rises above a first temperature so to prevent the application at said heat demand signal to close said fuel valve, and for preventing the energizing of said relay coil when the temperature at said heat exchanger drops below a second temperature to permit the application of said heat demand signal to open said fuel valve.

9. The flame control system of claim 8 wherein said switch means includes a switch connected in series with said relay coil and adapted to close when the temperature at said heat exchanger rises above said first temperature.

10. A flame control system for use with heat exchange systems of the type including a controller for initiating and terminating a heat demand cycle, a burner directly coupled to a fuel valve, said fuel valve being operable in the open position to provide a constant fuel supply to said burner and being operable in the closed position to prevent any fuel supply to said burner, said fuel valve being responsive to a heat demand signal from said controller, a heat exchanger proximate said burner, a fluid circulator arranged and adapted to remove heat from said heat exchanger, and a normally open fluid circulator switch, responsive to the temperature of said heat exchanger and operably coupled to said fluid circulator, adapted to close and activate said circulator when the temperature of said heat exchanger rises above a certain temperature, said control system comprising:

a temperature responsive switch means, placed in series with said controller and said fuel valve, for preventing the application of said heat demand signal to close said fuel valve when the temperature of said heat exchanger rises above a first temperature, and for permitting the reapplication of said heat demand signal to open said fuel valve when the temperature of said heat exchanger drops below a second temperature;

a normally closed third switch placed in parallel across said switch means; and means for opening said third switch when said fluid circulator switch is closed so that said heat demand signal from said controller to said fuel valve cannot be disrupted until after said fluid circulator has been activated.

11. A flame control system for use with heat exchange systems of the type including a controller for initiating and terminating a heat demand cycle, a burner directly coupled to a fuel valve, said fuel valve being operable in the open position to provide a constant fuel supply to said burner and being operable in the closed position to prevent any fuel supply to said burner, said fuel valve being responsive to a heat demand signal from said controller, a heat exchanger proximate the burner, a fluid circulator arranged and adapted to remove heat from said heat exchanger, and a normally open fluid circulator switch, responsive to the temperature of said heat exchanger and operably coupled to said fluid circulator, adapted to close and activate said circulator when the temperature of said heat exchanger rises above a certain temperature, the control system comprising:

a temperature responsive switch means, placed in series with said controller and said fuel valve, for preventing the application of said heat demand signal to close said fuel valve when the temperature of said heat exchanger rises above first temperature, and for permitting the reapplication of said heat demand signal to open said fuel valve when the temperature of said heat exchanger drops below a second temperature: and an environment responsive switch placed in parallel across said switch means and positioned remote from said heat exchanger, said environment responsive switch arranged and adapted to open sensing actuation of said fluid circulator to permit said switch means to control the cycling on and off of said heat exchanger during a heat demand cycle.

12. The control system of claim 11 wherein said environment responsive switch is responsive to temperature.

* * * * *